US008438984B2

(12) United States Patent
Hasegawa et al.

(10) Patent No.: US 8,438,984 B2
(45) Date of Patent: May 14, 2013

(54) EMBROIDERY FRAME

(71) Applicants: Katsuhisa Hasegawa, Kasugai (JP); Harumi Kato, Nagoya (JP); Midori Magara, Nagoya (JP)

(72) Inventors: Katsuhisa Hasegawa, Kasugai (JP); Harumi Kato, Nagoya (JP); Midori Magara, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 13/624,336

(22) Filed: Sep. 21, 2012

(65) Prior Publication Data

US 2013/0074750 A1 Mar. 28, 2013

(30) Foreign Application Priority Data

Sep. 28, 2011 (JP) ..... 2011-213072

(51) Int. Cl.
*D05C 7/04* (2006.01)

(52) U.S. Cl.
USPC ..... 112/103

(58) Field of Classification Search ..... 112/102, 112/103, 104, 102.5, 118, 119, 475.04, 475.18, 112/475.19; 38/102.2
See application file for complete search history.

(56) References Cited

U.S. PATENT DOCUMENTS

| | | | | | |
|---|---|---|---|---|---|
| 1,120,357 | A | * | 12/1914 | Austin | 38/102.2 |
| 4,247,998 | A | * | 2/1981 | Foss | 38/102.2 |
| 4,411,208 | A | * | 10/1983 | Nishida et al. | 112/103 |
| 4,422,250 | A | * | 12/1983 | Golan | 38/102.2 |
| 4,598,655 | A | | 7/1986 | Takenoya | |
| 4,774,778 | A | * | 10/1988 | Williams | 38/102.2 |
| 5,144,899 | A | * | 9/1992 | Allen | 112/103 |
| 5,222,314 | A | * | 6/1993 | Inteso | 38/102.2 |
| 5,970,895 | A | * | 10/1999 | Mack | 112/103 |

FOREIGN PATENT DOCUMENTS

| | | |
|---|---|---|
| JP | A 59-181185 | 10/1984 |
| JP | A 03-193090 | 8/1991 |
| JP | A 05-123464 | 5/1993 |
| JP | U 06-004094 | 1/1994 |
| JP | A 2002-136784 | 5/2002 |

* cited by examiner

*Primary Examiner* — Tejash Patel
(74) *Attorney, Agent, or Firm* — Oliff & Berridge, PLC

(57) ABSTRACT

An embroidery frame comprises an inner frame, wherein the inner frame is a circular form. The embroidery frame comprises a middle frame configured to be detachably attachable to the inner frame, wherein the middle frame is a circular form, an inside diameter of the middle frame is longer than an outside diameter of the inner frame, and the inner frame is configured to be mountable in the middle frame. The embroidery frame comprises an outer frame configured to rotatably hold the middle frame, wherein the outer frame is a circular form, an inside diameter of the outer frame is longer than an outer outside diameter of the middle frame, and the middle frame is configured to be mountable in the outer frame. The embroidery frame comprises an engaging portion configured to cause the middle frame to engage with the outer frame at a predetermined rotation angle.

5 Claims, 15 Drawing Sheets

EMBROIDERY FRAME

CROSS-REFERENCE TO RELATED APPLICATION

This application claims priority to Japanese Patent Application No. 2011-213072, filed on Sep. 28, 2011, the disclosure of which is hereby incorporated by reference herein in its entirety.

BACKGROUND

This disclosure relates to an embroidery frame that is configured to be attachable to a sewing machine.

An embroidery frame for a sewing machine is widely known. The embroidery frame is a circular form and the embroidery frame can be rotated to an intended angle. For example, the embroidery frame comprises a pair of embroidery frames and an outer frame. The pair of embroidery frames comprises a small embroidery frame and a big embroidery frame. The small embroidery frame is in a circular form and the big embroidery frame is also in a circular form. An inside diameter of the big embroidery frame is longer than an outside diameter of the small embroidery frame. A work cloth can be held between the small embroidery frame and the big embroidery frame. The outer frame can hold the pair of embroidery frames such that the pair of embroidery frames is rotatable. A fixation screw is provided on a side face of the outer embroidery frame. A triangular mark is provided on an upper face of the big embroidery frame and a plurality of scale marks indicative of angles are provided on the outer embroidery frame. The pair of embroidery frames can be rotated to the intended angle with respect to the outer embroidery frame by an user of the sewing machine, as the user looks at the triangular mark and the plurality of scale marks. After rotating, the fixation screw can be tightened by the user. In this manner, the pair of embroidery frames can be fixed to the outer embroidery frame.

SUMMARY

When the embroidery frame as described above is used by the user, the user has to adjust the pair of embroidery frames with respect to the outer embroidery frame, as the user looks at the triangular mark and the plurality of scale marks. The process of adjusting the pair of embroidery frames with respect to the outer embroidery frame may be burdensome for the user.

Various exemplary embodiments of the general principles herein provide an embroidery frame, which enables the user to adjust the pair of embroidery frames with respect to the outer embroidery frame easily.

Exemplary embodiments herein provide an embroidery frame that comprises an inner frame, a middle frame, an outer frame, and an engaging portion. The inner frame is a circular form. The middle frame is configured to be detachably attachable to the inner frame, wherein the middle frame is a circular form, an inside diameter of the middle frame is longer than an outside diameter of the inner frame, and the inner frame is configured to be mountable in the middle flame. The outer frame is configured to rotatably hold the middle frame, wherein the outer frame is a circular form, an inside diameter of the outer frame is longer than an outer outside diameter of the middle frame, and the middle frame is configured to be mountable in the outer frame. The engagement portion is configured to cause the middle frame to engage with the outer frame at a predetermined rotation angle.

BRIEF DESCRIPTION OF THE DRAWINGS

Exemplary embodiments of the present disclosure will be described below in detail with reference to the accompanying drawing in which.

DETAILED DESCRIPTION

Figure 1:
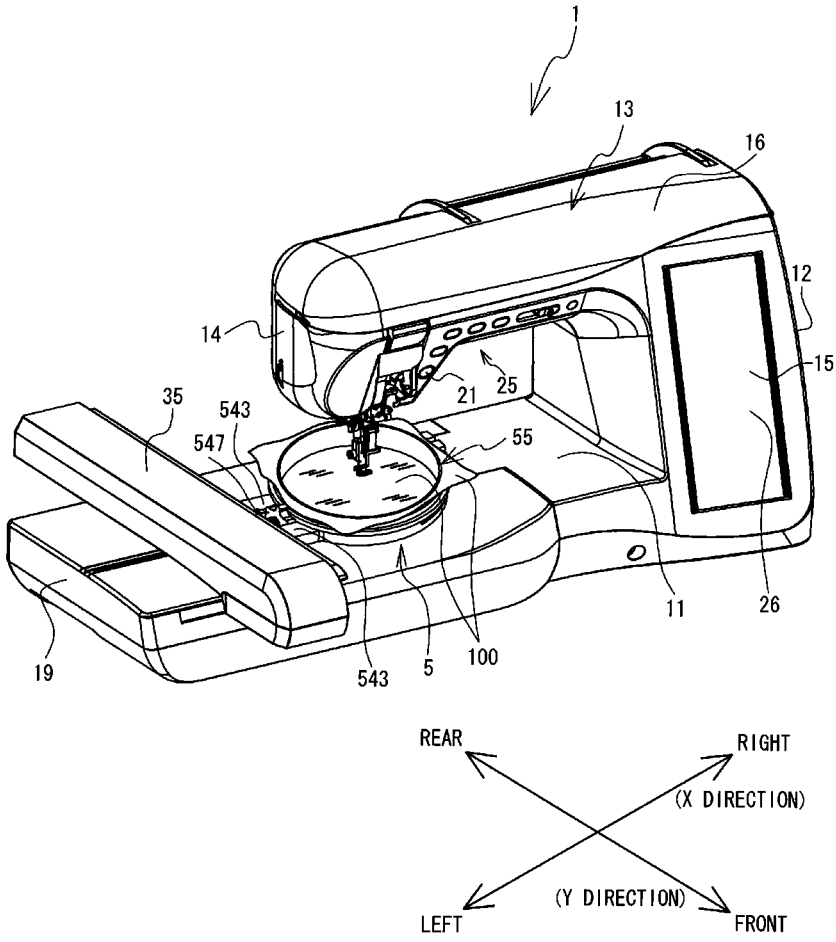
FIG. 1 is an oblique view of a sewing machine 1 on which an embroidery frame 5 is mounted.

Hereinafter, embodiments of the present disclosure will be explained with reference to the drawings. A configuration of a sewing machine 1 will be explained with reference to FIGS. 1 and 2. In FIG. 1, the side where a user of the sewing machine 1 is positioned is defined as the front side, and the opposite side is defined as the rear side. The left-right direction as seen by the user is defined as the left-right direction of sewing machine 1. That is, the face of the sewing machine 1 on which a switch cluster 25 that will be described later is provided is the front face of the sewing machine 1. The longitudinal direction of a bed 11 and an arm 13 are the left-right, direction of the sewing machine 1, and a side on which a pillar 12 is positioned is the right side of the sewing machine 1. A direction in which the pillar 12 extends is the up-down direction of the sewing machine 1.

As shown in FIG. 1, the sewing machine 1 is provided with the bed 11, the pillar 12, the arm 13, and a head 14. The bed 11 is a base portion of the sewing machine 1 and extends in the left-right direction. The pillar 12 extends upward from the right end of the bed 11. The arm 13 extends to the left from the upper end of the pillar 12 such that it is opposite the bed 11. The head 14 is a portion that connects to the left end of the arm 13. A needle plate (not shown in the drawings) is provided in the top face of the bed 11. A feed dog, a cloth feed mechanism, a feed adjustment pulse motor, and a shuttle mechanism that are not shown in the drawings are provided within the bed 11, underneath the needle plate. The feed dog may feed, by a specified feed amount, a work cloth on which sewing is performed. The cloth feed mechanism may drive the feed dog. The feed adjustment pulse motor may adjust the feed amount.

In a case where embroidery sewing is performed with the sewing machine 1, an embroidery frame 5 that holds a work cloth 100 may be disposed on the top side of the bed 11. An area on the inner side of the embroidery frame 5 is an embroidery area in which stitches of an embroidery pattern can be formed. A moving unit 19 that is configured to move the embroidery frame 5 may be removably mounted on the bed 11. A carriage cover 35 that extends in the front-rear direction is provided on the upper part of the moving unit 19. A Y axis moving mechanism (not shown in the drawings) is provided inside the carriage cover 35. The Y axis moving mechanism is configured to move a carriage (not shown in the drawings) in Y axis direction (the front-rear direction of the sewing machine 1). The embroidery frame 5 has a structure that allows it to be removably mounted on the carriage. A mounting portion (not shown in the drawings) on which the embroidery frame 5 may be mounted is provided on the right side of the carriage. The mounting portion projects to the right from the right side face of the carriage cover 35. An attachment portion 542 (refer to FIG. 4) that is provided on the embroidery frame 5 may be mounted on the mounting portion. The carriage, the Y axis moving mechanism, and the carriage cover 35 may be moved in an X axis direction (the left-right direction of the sewing machine 1) by an X axis moving mechanism (not shown in the drawings). The X axis moving mechanism is provided inside the body of the moving unit 19.

The X axis moving mechanism and the Y axis moving mechanism may be respectively driven by an X axis motor and a Y axis motor that are not shown in the drawings. A needle bar 6 (refer to FIG. 2) and the shuttle mechanism (not shown in the drawings) may be driven as the embroidery frame 5 is moved in the X axis direction and the Y axis direction. In this manner, an embroidery sewing operation that sews a specified embroidery pattern in the work cloth 100 that is held in the embroidery frame 5 and an operation that forms a cut in the work cloth 100 in a specified shape are performed. In a case where an ordinary pattern that is not an embroidery pattern is sewn, the moving unit 19 may be removed from the bed 11, and the work cloth 100 may be disposed on the bed 11. Then ordinary sewing may be performed by the driving of the needle bar 6 and the shuttle mechanism as the work cloth 100 is moved by the feed dog.

A vertically rectangular liquid crystal display 15 is provided on the front face of the pillar 12. Images of various types of items, such as a plurality of types of patterns, names of commands that cause various types of functions to be performed, various types of messages, and the like, may be displayed on the liquid crystal display 15.

A transparent touch panel 26 is provided on the front face of the liquid crystal display 15. Using a finger or a special touch pen, the user may perform a pressing operation on the touch panel 26. Hereinafter, this operation is referred to as a panel operation. The touch panel 26 may detect a position that is pressed by a finger or a special touch pen etc., and the sewing machine 1 may determine the hem that corresponds to the detected position. Thus, the sewing machine 1 may recognize the selected item. By performing the panel operation, the user can select a pattern to be sewn or a command to be executed.

The structure of the arm 13 will be explained. A cover 16 is provided in the top part of the arm 13. The cover 16 is axially supported such that it can be opened and closed by being rotated about an axis that extends in the left-right direction at the upper rear edge of the arm 13. A thread container portion (not shown in the drawings) is provided underneath the cover 16, that is, in the interior of the arm 13. The thread container portion may contain a thread spool (not shown in the drawings) that supplies an upper thread. The upper thread may be supplied from the thread spool to a sewing needle 7 (refer to FIG. 2) through a thread hook portion that includes a tensioner, a thread take-up spring and a thread take-up lever that are not shown in the drawings. The tensioner is provided in the head 14 and configured to adjust the thread tension. The thread take-up lever may be driven reciprocally up and down and pull the upper thread upward. The needle bar 6 may be moved up and down by a needle bar up-and-down moving mechanism (not shown in the drawings) that is provided inside the head 14. The needle bar up-and-down moving mechanism may be driven by a drive shaft (not shown in the drawings) that is rotationally driven by a sewing machine motor (not shown in the drawings).

The switch cluster 25, which includes a sewing star/stop switch 21 and the like, is provided in the lower part of the front face of the arm 13. The sewing start/stop switch 21 may be used to start and stop the operation of the sewing machine 1. That is, the sewing start/stop switch 21 may be used by the user to issue commands to start and stop the sewing.

Figure 2:
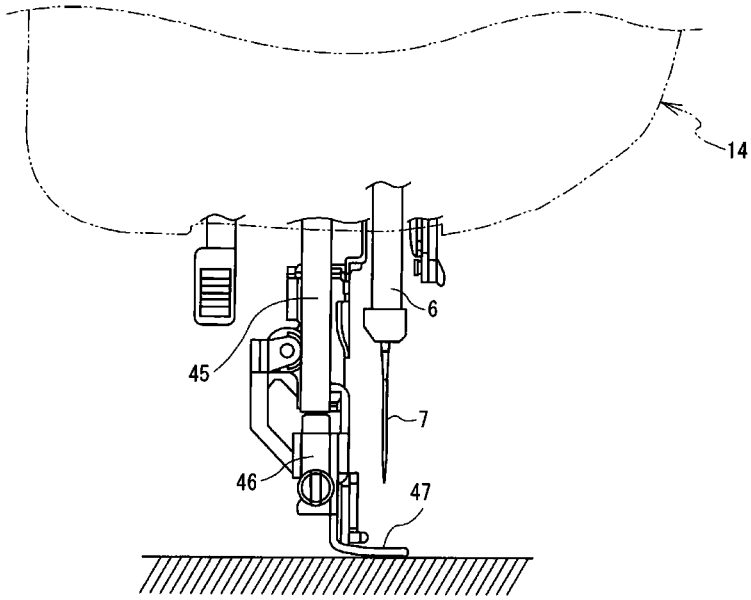
FIG. 2 is a left side view of a needle bar 6, to which a sewing needle 7 is attached, and an area around the needle bar 6.

As shown in FIG. 2, the needle bar 6 is provided in the lower portion of the head 14. One of the sewing needle 7 (refer to FIG. 2) and a cutwork needle 8 (refer to FIG. 3) can be attached to the lower end of the needle bar 6. A presser bar 45 is provided to the rear of the needle bar 6. A presser holder 46 may be attached to the lower end of the presser bar 45. A presser foot 47, which may press down on the work cloth 100, may be fixed to the presser holder 46.

Figure 3:
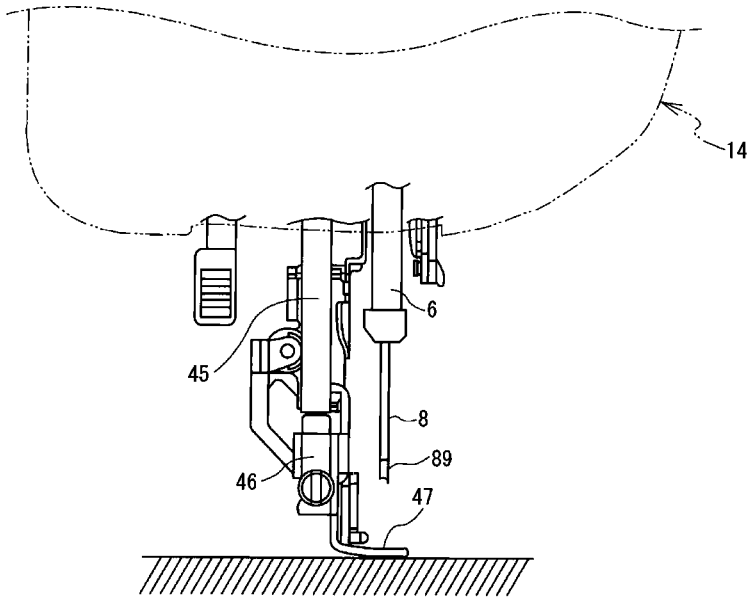
FIG. 3 is a left side view of the needle bar 6, to which a cutwork needle 8 is attached, and the area around the needle bar 6.

The cutwork needle 8 will be explained. As shown in FIG. 3, a cutting portion 89 is formed at the tip of the cutwork needle 8. The cutting portion 89 has a sharp-pointed shape in a front view and has a specified width in the front-rear direction in a side view (the left-right direction in FIG. 3). The lower edge of the cutting portion 89 curves obliquely downward from the rear edge to the front edge. When the needle bar 6 is moved up and down in a state in which the cutwork needle 8 is attached to the lower end of the needle bar 6, a cut that extends in the front-rear direction is formed in the work cloth 100. The length of the cut is the same as the width of the cutting portion 89 of the cutwork needle 8. Embroidery sewing and ordinary sewing can be performed when the needle bar 6 is moved up and down in a state in which the sewing needle 7 is attached to the lower end of the needle bar 6, as shown in FIG. 2.

Figure 4:
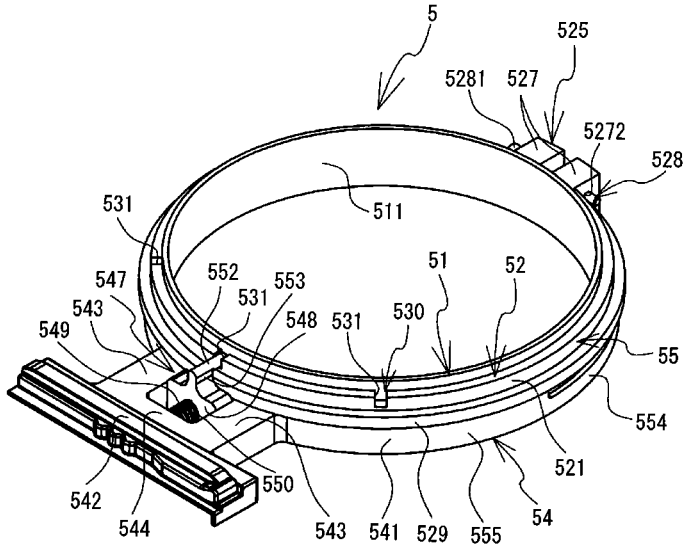
FIG. 4 is an oblique view of the embroidery frame 5.
Figure 5:
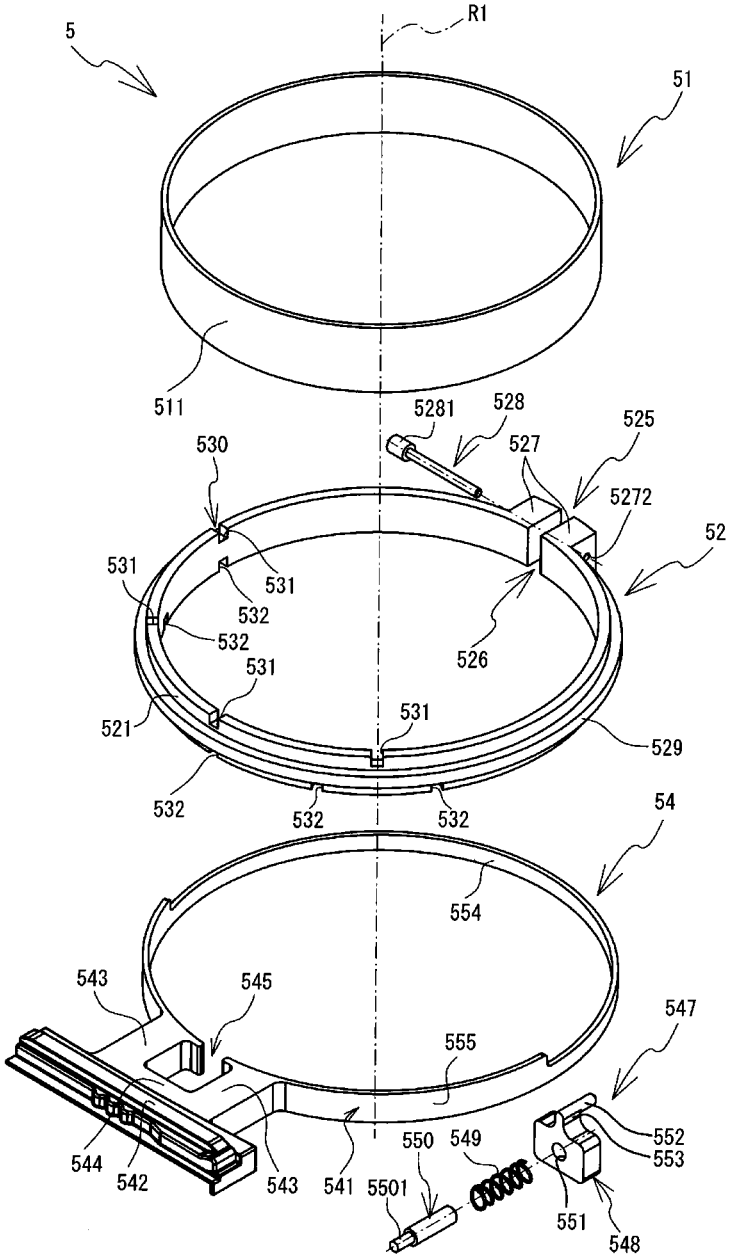
FIG. 5 is an exploded oblique view of the embroidery frame 5.

The embroidery frame 5 will be explained with reference to FIGS. 4 to 8. In the explanation that follows, the up-down direction in FIGS. 4 and 5 is defined as the up-down direction of the embroidery frame 5. That is, the side on which an outer frame 54 that will be described later is disposed is the bottom side of the embroidery frame 5, and the side on which a middle frame 52 (an assembled unit 55) is disposed is the top side of the embroidery frame 5. As shown in FIGS. 4 and 5, the embroidery frame 5 includes an inner frame 51, the middle frame 52, and the outer frame 54, each of which has a circular frame shape. As shown in FIG. 4, the embroidery frame 5 is formed by disposing the middle frame 52 to the outside of the inner frame 51 in the radial direction, and by disposing the outer frame 54 to the outside of the middle frame 52 in the radial direction. The inner frame 51 and the middle frame 52 can be rotated about a rotational axis R1 shown in FIG. 5, in relation to the outer frame 54. Note that, in the embroidery frame 5 according to the present embodiment, the rotational axis R1 passes thorough the center of each circle that is formed by each of the inner frame 51, the middle frame 52, and the outer frame 54 (specifically, frame portions 511, 521, and 541, which are described below). Hereinafter, the direction of the rotational axis R1 is simply referred to as an "axial direction".

As shown in FIGS. 4 and 5, the inner frame 51 includes a circular frame portion 511. The frame portion 511 has a thickness in the axial direction (the up-down direction in FIGS. 4 and 5). The middle frame 52 includes a circular frame portion 521 that has an inside diameter that is larger than the outside diameter of the frame portion 511 of the inner frame 51. The middle frame 52 may be removably mounted on the inner frame 51 by removably mounting the frame portion 521 of the middle frame 52 on the outer side of the frame portion 511 of the inner frame 51 in the radial direction. The work cloth 100 can be held between the inner frame 51 and the middle frame 52 (refer to FIG. 1.)

Figure 6:
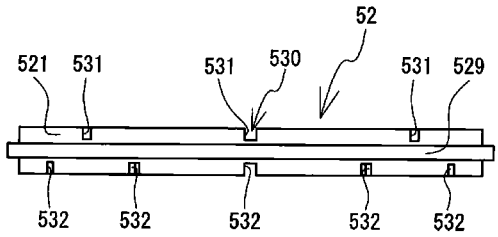
FIG. 6 is a side view of a middle frame 52.

As shown in FIGS. 5 and 6, a plurality of first engaging portions 530 are provided on both edges in the axial direction of the frame portion 521, that is, on the upper edge and the lower edge. As described above, the axial direction corresponds to the up-down direction of the embroidery frame 5. Therefore, the plurality of first engaging portions 530 are provided in a plurality of positions around the circumference of the middle frame 52 that respectively correspond to a plurality of predetermined rotation angles (rotation angles of the middle frame 52 in relation to the outer frame 54). The plurality of first engaging portions 530 include a plurality of first edge engaging portions 531 and a plurality of second edge engaging portions 532. In the present embodiment, when a second engaging portion 547 that will be described later engages with one of the first engaging portions 530, the middle frame 52 can be locked at one of the predetermined rotation angles in relation to the outer frame 54. Each of the first engaging portions 530 may be formed in the frame portion 521 as a recessed portion that is recessed in a direction away from the outer frame 54, that is, a direction toward the inner side of the middle frame 52 in the radial direction. In the present embodiment, each of the first engaging portions 530 is formed as a through-hole that passes through the frame portion 521 in the direction away from the outer frame 54.

Figure 7:
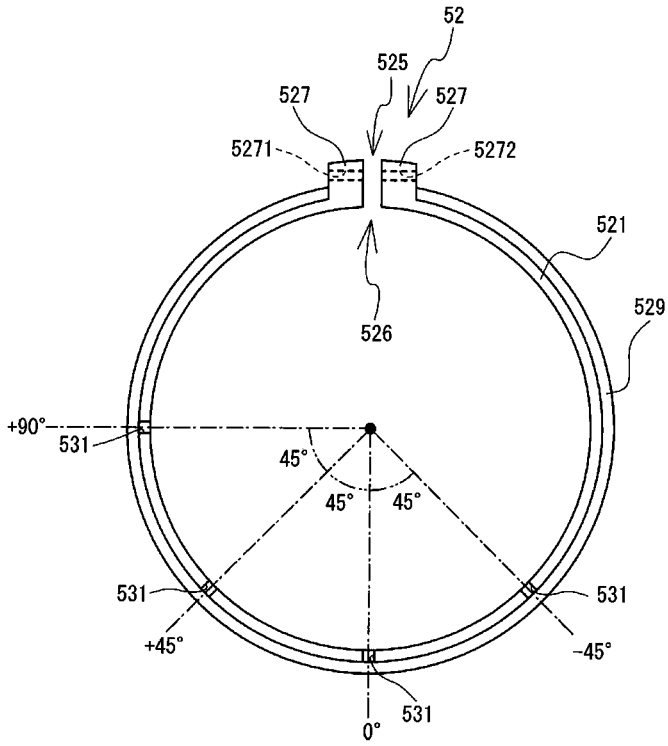
FIG. 7 is a plan view of the middle frame 52 in a state in which a plurality of first edge engaging portions 531 are facing upward.
Figure 8:
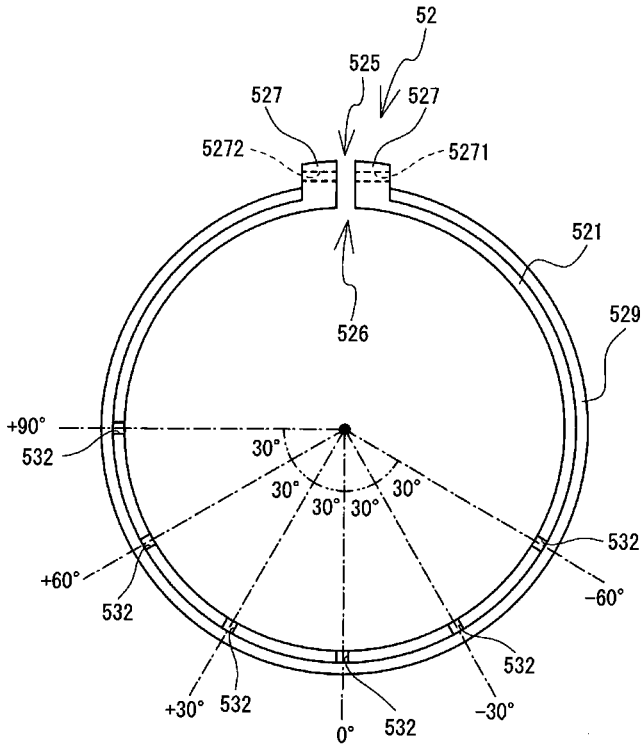
FIG. 8 is a plan view of the middle frame 52 in a state in which a plurality of second edge engaging portions 532 are facing upward.

Among the first engaging portions 530, the first edge engaging portions 531 are provided on one edge of the frame portion 521 in the axial direction (the upper edge in the present embodiment). As shown in FIG. 7, in the present embodiment, four first edge engaging portions 531 are provided at intervals of 45 degrees (45°) as seen from the central axis of the middle frame 52. The second edge engaging portions 532 are provided on the other edge of the frame portion 521 in the axial direction (the lower edge in the present embodiment). The first edge engaging portions 531 and the second edge engaging portions 532 are provided around the circumference of the frame portion 521, with at least some of the positions in which the first edge engaging portions 531 are provided corresponding to different rotation angles from those to which at least some of the positions in which the second edge engaging portions 532 are provided correspond. As shown in FIG. 8, in the present embodiment, six second edge engaging portions 532 are provided at intervals of 30 degrees (30°) as seen from the central axis of the middle frame 52.

Note that in the present embodiment, the position of the one of the first edge engaging portions 531 that is on the opposite side from an adjustment portion 525 (described later) in the radial direction of the middle frame 52 is defined as the position that corresponds to a rotation angle of zero degrees, as shown in FIG. 7. In relation to a line that connects the central axis of the middle frame 52 with this one of the first edge engaging portions 531, the clockwise direction in a plan view is defined as positive (+), and the counterclockwise direction in a plan view is defined as negative (−). As shown in FIG. 7, the four first edge engaging portions 531 are provided at the positions of −45 degrees, zero degrees, +45 degrees, and +90 degrees. Similarly, the position of the one of the second edge engaging portions 532 that is on the opposite side from the adjustment portion 525 in the radial direction of the middle frame 52 is defined as the position that corresponds to a rotation angle of zero degrees, as shown in FIG. 8. In relation to a line that connects the central axis of the middle frame 52 with this one of the second edge engaging portions 532, the clockwise direction in a plan view is defined as positive (+), and the counterclockwise direction in a plan view is defined as negative (−). As shown in FIG. 8, the six second edge engaging portions 532 are provided at the positions of −60 degrees, −30 degrees, zero degrees, +30 degrees, +60 degrees, and +90 degrees. As shown in FIGS. 7 and 8, the first edge engaging portions 531 and the second edge engaging portions 532 are provided at locations around approximately half of the circumference of the frame portion 521, on the opposite side from the location where the adjustment portion 525 is provided.

As shown in FIGS. 5 and 7, the middle frame 52 includes the adjustment portion 525, which can adjust the diameter of the middle frame 52 according to the thickness of the work cloth 100 that is clamped between the inner frame 51 and the middle frame 52. The adjustment portion 525 includes a parting portion 526, a pair of screw mounting portions 527, and an adjusting screw 528. The parting portion 526 is a location where a portion in the circumferential direction of the frame portion 521 of the middle frame 52 is discontinuous through the axial direction. The pair of the screw mounting portions 527 project to the outside in the radial direction and are positioned opposite one another on opposite sides of the parting portion 526 in the frame portion 521. The lengths of the screw mounting portions 527 in the axial direction (the up-down direction in FIG. 5) are the same as the length of the frame portion 521 in the axial direction. Holes 5271, 5272 are provided in the pair of the screw mounting portions 527, each of the holes 5271, 5272 passing through one of the screw mounting portions 527 in a direction that is orthogonal to the face that is opposite the other one of the screw mounting portions 527, that is, in the direction in which the pair of the screw mounting portions 527 are opposite one another (the left-right direction in FIG. 7). Of the two holes 5271, 5272, a threaded hole is formed in the hole 5272 (the hole on the right side in FIG. 7).

The adjusting screw 528 is a screw that includes a head portion 5281 that projects outward in the radial direction at one end of the adjusting screw 528 (refer to FIG. 5). In a case where the diameter of the middle frame 52 is adjusted, first, the adjusting screw 528 is inserted from the side of the hole 5271 (the left side in FIG. 7), in which a threaded hole is not formed, toward the hole 5272, in which the threaded hole is formed. Then the adjusting screw 528 is rotated and passes through the inside of the hole 5272. At this time, the head 5281 of the adjusting screw 528 presses against the screw mounting portion 527, changing the size of the gap between the pair of the screw mounting portions 527. Thus, in addition to connecting the pair of the screw mounting portions 527, the adjusting screw 528 is able to adjust the gap between the pair of the screw mounting portions 527. The diameter of the middle frame 52 can be adjusted by adjusting the gap between the pair of the screw mounting portions 527. For example, the diameter of the middle frame 52 becomes greater as the gap between the pair of the screw mounting portions 527 becomes wider, so a thicker work cloth 100 can be clamped between the middle frame 52 and the inner frame 51.

A flange portion 529 that projects outward in the radial direction is provided in a central portion in the axial direction of the outer circumferential side face of the frame portion 521, except where the screw mounting portions 527 are located. In a case where the middle frame 52 is mounted on the outer frame 54, the flange portion 529 is supported by a second supporting portion 555 (described later) of the outer frame 54 (refer to FIG. 4).

As shown in FIGS. 4 and 5, the outer frame 54 includes a circular frame portion 541. The frame portion 541 includes a first supporting portion 554 and the second supporting portion 555. The first supporting portion 554 is a portion that is formed by cutting out an upper portion of the approximately half of the circumference of the frame portion 541. The second supporting portion 555 is the portion of the frame portion 541 other than the first supporting portion 554. The upper edge of the first supporting portion 554 is positioned at approximately half the height of the second supporting portion 555. In a case where the middle frame 52 is mounted on the outer frame 54, the screw mounting portions 527 of the middle frame 52 are supported by the first supporting portion 554, and the flange portion 529 of the middle frame 52 is supported by the second supporting portion 555 (refer to FIG. 4). The first supporting portion 554 is provided around approximately half of the circumference of the frame portion 541, so the user is able to move the screw mounting portions 527 in the circumferential direction through the range in which the first supporting portion 554 is provided. This makes it possible for one of the first engaging portions 530 to engage with the second engaging portion 547.

A parting portion 545 where a portion of the frame portion 541 is discontinuous through the axial direction is provided in the frame portion 541, approximately in the center of the circumferential direction of the second supporting portion 555. A pair of arms 543 that project outward in the radial direction are provided on the frame portion 541 in positions that are slightly separated from the respective sides of the parting portion 545. The pair of the arms 543 are joined by an arm joining portion 544 at the ends of the arms 543 that are opposite the ends that are connected to the frame portion 541. The arm joining portion 544 extends approximately parallel to the direction (hereinafter called the tangent line direction) in which extends a line that is tangent to the circular frame portion 541 at the parting portion 545.

The attachment portion 542, which extends approximately parallel to the tangent line direction, is provided on the edge of the arm joining portion 544 that is on the opposite side from the middle frame 52. The attachment portion 542 is configured such that it can be mounted on the mounting portion (not shown in the drawings) of the carriage that is provided inside the carriage cover 35 of the sewing machine 1.

As shown in FIG. 4, the second engaging portion 547 is provided in a space that is bounded by the parting portion 545, the pair of the arms 543, and the arm joining portion 544. As shown in FIG. 5, the second engaging portion 547 includes an engaging member 548, a coil spring 549, and a shaft portion 550. The engaging member 548, which has the shape of a rectangular parallelepiped, is disposed between the parting portion 545 and the arm joining portion 544 such that a pair of opposite faces of the engaging member 548 are approximately parallel to the tangent line. The length of the engaging member 548 in a width direction (the tangent line direction) is slightly shorter than the distance between the pair of the arms 543 (the inside dimension). A hole 551 is provided in a central portion of the engaging member 548 in the width direction and the up-down direction. The hole 551 passes through the engaging member 548 approximately orthogonally to the pair of the faces of the engaging member 548 that are approximately parallel to the tangent line. A grip portion 553 that projects upward is provided in the upper part of the engaging member 548, in the center in the width direction. The grip portion 553 is formed into a shape that the user can easily grip with his fingers when the user pulls the engaging member 548 away from the middle frame 52. A cylindrical projecting portion 552 that projects toward the middle frame 52 is provided on the upper edge of the grip portion 553. The projecting portion 552 is made in a size that allows it to be inserted into one of the plurality of the first engaging portions 530 (refer to FIG. 4).

The shaft portion 550 is a cylindrical member. An end portion 5501 of the shaft portion 550 has a diameter that is smaller than that of the rest of the shaft portion 550. A hole that is not shown in the drawings is provided in the face of the arm joining portion 544 on the parting portion 545 side. The shaft portion 550 is fixed to the arm joining portion 544 by firmly pressing the end portion 5501 of the shaft portion 550 into the hole.

As shown in FIGS. 4 and 5, the opposite end of the shaft portion 550 from the end portion 5501, that is, the end of the shaft portion 550 that is disposed on the middle frame 52 side, is inserted into the hole 551 in the engaging member 548. The engaging member 548 is able to slide in the axial direction of the shaft portion 550. However, because the engaging member 548 is held between the pair of the arms 543, it cannot rotate in relation to the shaft portion 550. The expandable and compressible coil spring 549 is mounted around the outer circumferential face of the shaft portion 550. The coil spring 549 is compressed between the face of the arm joining portion 544 and the face of the engaging member 548 that are opposite one another. The engaging member 548 is thus energized toward the middle frame 52 by the elastic force of the coil spring 549. In a case where the middle frame 52 is not mounted on the outer frame 54, the face of the engaging member 548 on the frame portion 541 side is pressed by the elastic force of the coil spring 549 into contact with the outer circumferential face of the frame portion 541 on both sides of the parting portion 545. The projecting portion 552 projects through the upper side of the parting portion 545 into the inner side of the frame portion 541. When the user grips the grip portion 553 and pulls the engaging member 548 away from the middle frame 52, the engaging member 548 and the projecting portion 552 move away from the middle frame 52 in opposition to the elastic force of the coil spring 549.

Next, the mode in which the inner frame 51, the middle frame 52 and the outer frame 54 are combined will be explained. In the present embodiment, in a case where the middle frame 52 and the outer frame 54 are combined such that the first edge engaging portions 531 are positioned on the upper side of the outer frame 54, the second engaging portion 547 can be engaged with one of the first edge engaging portions 531. The state of the middle frame 52 in this case, that is, the state in which the first edge engaging portions 531 are on the upper side of the outer frame 54, is called a first state. Furthermore, in a case where the middle frame 52 and the outer frame 54 are combined such that the second edge engaging portions 532 are positioned on the upper side of the outer frame 54, the second engaging portion 547 can be engaged with one of the second edge engaging portions 532. The state of the middle frame 52 in this case, that is, the state in which the second edge engaging portions 532 are on the upper side of the outer frame 54, is called a second state. As described previously, the first edge engaging portions 531 are provided at intervals of 45 degrees, and the second edge engaging portions 532 are provided at intervals of 30 degrees. Therefore, in the first state, the middle frame 52 can be locked in relation to the outer frame 54 in a position that corresponds to one of the rotation angles, among the plurality of the positions that are provided in correspondence to the plurality of rotation angles at intervals of 45 degrees. In the second state, the middle frame 52 can be locked in relation to the outer frame 54 in a position that corresponds to one of the rotation angles, among the plurality of the positions that are provided in correspondence to the plurality of rotation angles at intervals of 30 degrees.

A method will be explained for combining the inner frame 51, the middle frame 52, and the outer frame 54 such that the work cloth 100 can be rotated in 45-degree units using the first edge engaging portions 531 in a state in which the middle frame 52 is in the first state. First, the user may place the middle frame 52 on a desktop or the like such that the first edge engaging portions 531 are on the top side. Next, the user may place the work cloth 100 on the top side of the middle frame 52. Then the user may insert the inner frame 51 into the inner side of the middle frame 52 while pressing the work cloth 100 downward with the bottom edge of the inner frame 51. The work cloth 100 may be thus clamped between the inner frame 51 and the middle frame 52. The user, by adjusting the adjustment portion 525, may adjust the diameter of the middle frame 52 in accordance with the thickness of the work cloth 100. The face of the work cloth 100 on which the sewing will be performed may enter a state of being stretched taut on the inner side of the inner frame 51 by the bottom edge of the inner frame 51. In the explanation that follows, the frame that is formed by the combining of the inner frame 51 and the middle frame 52 is called the assembled unit 55 (refer to FIGS. 1, 4, 9, 10).

Next, the user may set the assembled unit 55 into the outer frame 54 from the top side of the outer frame 54, such that the screw mounting portions 527 are supported by the first supporting portion 554 and the flange portion 529 is supported by the second supporting portion 555. This may determine the position of the assembled unit 55 in the axial direction. At this time, the user may grip the grip portion 553 with his fingers and pull the engaging member 548 away from the middle frame 52, retracting the projecting portion 552 to the outside of the frame portion 541, such that the projecting portion 552 does not make contact with the middle frame 52. Then, in order to position the assembled unit 55 at the desired angle in relation to the outer frame 54, the user may rotate the assembled unit 55 such that the position of one of the first edge engaging portions 531 that are provided at 45-degree intervals corresponds to the position of the projecting portion 552.

When the assembled unit 55 is set into the outer frame 54, the screw mounting portions 527 of the middle frame 52 are supported by the first supporting portion 554 of the outer frame 54. Furthermore, the flange portion 529 of the middle frame 52 is supported by the second supporting portion 555 of the outer frame 54. This may determine the position of the assembled unit 55 in the axial direction.

Figure 9:
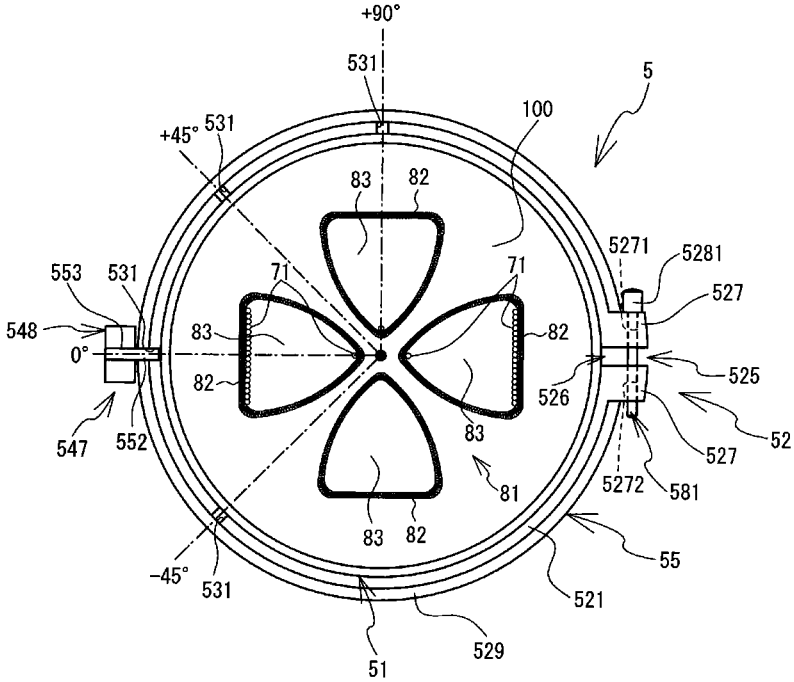
FIG. 9 is an explanatory figure that shows a state in which the middle frame 52 is locked at a position of zero degrees.

When the user takes his fingers off of the grip portion 553, the engaging member 548 may be energized in the direction of the middle frame 52 by the elastic force of the coil spring 549, and the projecting portion 552 may be inserted into the corresponding one of the first edge engaging portions 531 (refer to FIGS. 4 and 9). The second engaging portion 547 may be thus engaged with one of the first engaging portions 530 (one of the first edge engaging portions 531), and the middle frame 52 (the assembled unit 55) can be locked in relation to the outer frame 54.

The assembled unit 55 may be pushed in the direction away from the attachment portion 542 (the upper right direction in FIG. 4) by the elastic force of the coil spring 549. Therefore, even in a case where a slight gap exists between the outer circumferential face of the middle frame 52 and the inner circumferential face of the outer frame 54, due to the reducing of the diameter of the middle flame 52, a backlash can be suppressed and the middle frame 52 (the assembled unit 55) can be reliably fixed in position in relation to the outer frame 54. The inner frame 51, the middle frame 52, and the outer frame 54 can be combined as described above to obtain the completed form of the embroidery frame 5. Through the attachment portion 542, the user may attach the completed form of the embroidery frame 5 to the carriage of the moving unit 19 that is mounted on the sewing machine 1 (refer to FIG. 1). Hereinafter, in order to simplify the explanation, this operation is described simply as attaching the embroidery frame 5 to the sewing machine 1.

Figure 10:
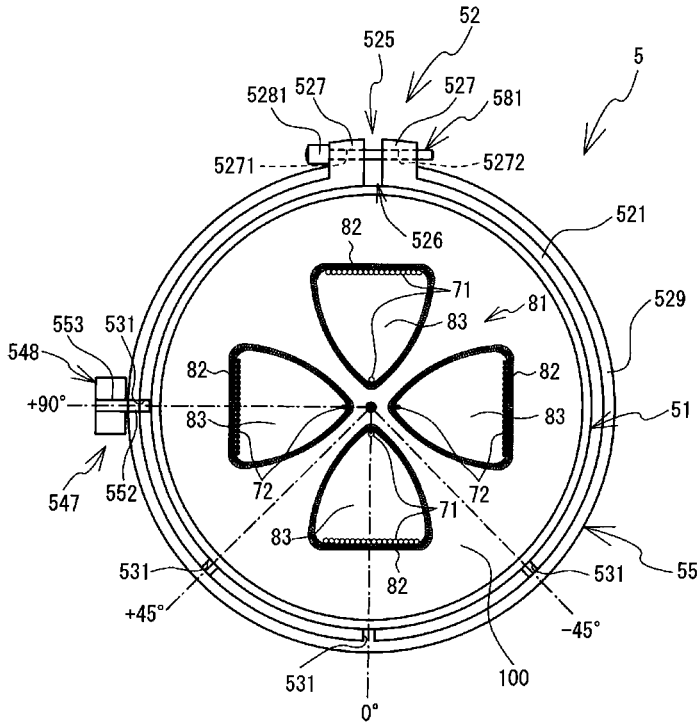
FIG. 10 is an explanatory figure that shows a state in which the middle frame 52 is locked at a position of +90 degrees.

Next, a method for forming a cutwork in the work cloth 100 using the embroidery frame 5 will be explained with reference to FIGS. 9 and 10. As an example of a cutwork, an example will be explained in which a plurality of areas 83 are cut out on inner sides of four flower petal patterns 82 in a flower pattern 81 that is shown in FIG. 9. Note that in FIGS. 9 and 10, only the portion of the work cloth 100 that is on the inner side of the inner frame 51 is shown. For the outer frame 54, only the engaging member 548 of the second engaging portion 547 is shown. Furthermore, FIGS. 9 and 10 show the state of the embroidery frame 5 when the embroidery frame 5 is attached to the sewing machine 1 (refer to FIG. 1), and the lower side, the upper side, the left side, and the right side of the drawings respectively correspond to the front side, the rear side, the left side, and the right side of the sewing machine 1. In the explanation that follows, the embroidery sewing and the forming of the cuts may be accomplished by a control circuit such as a CPU or the like of the sewing machine 1, which is not shown in the drawings, to control the movement of the carriage, the up and down movements of the needle bar 6, and the like according to embroidery data that have been set in advance.

As shown in FIG. 9, first the flower pattern 81 is sewn as an embroidery pattern in the work cloth 100. The flower pattern 81 is formed in the work cloth 100 that is held in the embroidery frame 5 by performing embroidery sewing in the form of satin stitches along the outlines of the four flower petal patterns 82. Thereafter, in order to cut out the areas 83 on the inner sides of the four flower petal patterns 82, the user replaces the sewing needle 7 (refer to FIG. 2) with the cutwork needle 8 (refer to FIG. 3). At this time, the cutting portion 89 of the cutwork needle 8 is fixed in place such that it extends in the front-rear direction, as shown in FIG. 3. As described previously, when the needle bar 6 moves up and down, a cut is formed by the cutting portion 89 in the front-rear direction of the sewing machine 1. Therefore, in order to cut out all of the four areas 83 in the work cloth 100, it is necessary to change the rotation angle of the middle frame 52 (the assembled unit 55) in relation to the outer frame 54 a plurality of times. For example, first, a cut is formed in the work cloth 100 in a state in which the one of the first edge engaging portions 531 that is in the zero-degree position is engaged with the second engaging portion 547, as shown in FIG. 9. In FIG. 9, needle drop points 71 for the cutwork needle 8 when the cuts are formed in the work cloth 100 in this state are shown as white circles. The cuts are formed in the work cloth 100 in the front-rear direction of the sewing machine 1, such that the white circles are joined.

Then the sewing machine 1 displays the rotation angle of the embroidery frame 5 on the liquid crystal display 15, in order to report to the user the angle to which the embroidery frame 5 should be rotated. For example, in a case where "+90 degrees" is displayed, the user grips the grip portion 553 of the engaging member 548 with his fingers and pulls the engaging member 548 in the direction away from the middle frame 52 (the leftward direction in FIG. 9), thereby separating the projecting portion 552 from the first edge engaging portion 531 that is in the zero-degree position. The engagement between the projecting portion 552 and the first edge engaging portion 531 that is in the zero-degree position is thus released, making it possible to rotate the middle frame 52 (the assembled unit 55). As shown in FIG. 10, the user rotates the assembled unit 55 90 degrees in the counterclockwise direction in a plan view, thereby moving the first edge engaging portion 531 that is in the +90-degree position to a position where it faces the projecting portion 552. The user release his grip on the grip portion 553, and the projecting portion 552 engages with the first edge engaging portion 531 that is in the +90-degree position. Thus the middle frame 52 is locked in relation to the outer frame 54, in a state in which the rotation angle of the middle frame 52 (the assembled unit 55) in relation to the outer frame 54 is +90 degrees. In FIG. 10, needle drop points 72 for the cutwork needle 8 when the cuts are formed in the work cloth 100 in this state are shown as black circles. When the rotating of the middle frame 52 (the assembled unit 55) and the forming of the cuts are further repeated in the same manner, the cutwork is completed for the flower pattern 81, in which all of the areas 83 have been cut out on the inner sides of the four flower petal patterns 82.

In the explanation above, the rotating of the middle frame 52 (the assembled unit 55) is performed, and the cuts are formed, using, among the first engaging portions 530, the first edge engaging portions 531 that are positioned at 45-degree intervals. In this case, the user is able to rotate the middle frame 52 at intervals of 45 degrees. However, there may be cases in which the user wants to rotate the middle frame 52 to an angle that is less than 45 degrees, as in a case of a cutwork for a complicated pattern, for example. In this case, the user may invert the middle frame 52 vertically, switching the middle frame 52 from the first state to the second state. Then, as described previously, the user may clamp the work cloth 100 between the inner frame 51 and the middle frame 52, which is in the second state. In the second state, the second edge engaging portions 532, which are disposed at 30-degree intervals, are positioned on the top side of the outer frame 54, so the projecting portion 552 can be inserted into one of the second edge engaging portions 532. The user is therefore able to rotate the middle frame 52 at 30-degree intervals. By switching the state of the middle frame 52 in relation to the outer frame 54 in this manner, the user can easily switch between a positional relationship in which the projecting portion 552 can engage with one of the first edge engaging portions 531 and a positional relationship in which the projecting portion 552 can engage with one of the second edge engaging portions 532. The convenience for the user can be improved accordingly.

As has been explained, in the present embodiment, it is possible to lock the middle frame 52 at one of a plurality of predetermined rotation angles in relation to the outer frame 54 by engaging the second engaging portion 547 with one of the first engaging portions 530. Therefore, it may be easier for the user to adjust the angle of the middle frame 52 in relation to the outer frame 54 than in a case where the user adjusts the angle of the middle frame in relation to the outer frame while checking a graduated scale or markings, as with the known embroidery frame. The user is also able to adjust the rotation angle of the middle frame 52 to the desired angle just by selecting one of the first engaging portions 530 that corresponds to the desired angle.

Because the coil spring 549 energizes the projecting portion 552 toward the middle frame 52, the projecting portion 552 can be inserted into the first engaging portion 530. The middle frame 52 can thus be reliably locked at the set angle in relation to the outer frame 54. Furthermore, in a case where the middle frame 52 is rotated in relation to the outer frame 54, the engagement of the projecting portion 552 with the first engaging portion 530 can easily be released by the user's pushing or the like on the engaging member 548 to apply force to the coil spring 549 in the direction away from the middle frame 52. The user is thus able to rotate the middle frame 52 easily.

The user can adjust the diameter of the middle frame 52 by adjusting the gap between the screw mounting portions 527, that is, the length of the parting portion 526. The user is therefore able to adjust the diameter of the middle frame 52 in accordance with the thickness of the work cloth 100 that is clamped between the inner frame 51 and the middle frame 52, causing the work cloth 100 to be held appropriately by the inner frame 51 and the middle frame 52. Furthermore, the first supporting portion 554 can support the screw mounting portions 527, and the second supporting portion 555 can support the flange portion 529, so the outer frame 54 is able to hold the middle frame 52 appropriately.

In the case of the known embroidery frame, in the state in which the work cloth is held in the embroidery frame, the graduated scale or markings that are used for adjusting the angle of the embroidery frame may be covered by the work cloth. Then it may be difficult for the user to see the graduated scale or markings. In this sort of case, it may be difficult for the user to efficiently perform the work of adjusting the rotation angle. In the present embodiment, the user is able to lock the middle frame 52 at a specified angle in relation to the outer frame 54 even though no graduated scale or markings are used, so the rotation angle can be adjusted efficiently.

Furthermore, in the case of the known embroidery frame, the middle frame may be locked in relation to the outer frame using a screw, so the operation may be burdensome. In the present embodiment, the user is able to release the locking of the middle frame 52 in relation to the outer frame 54 just by gripping the grip portion 553 of the engaging member 548 with his fingers and pulling the engaging member 548 in the direction away from the middle frame 52. The user is also able to lock the middle frame 52 in relation to the outer frame 54 just by releasing his fingers from the grip portion 553 after the rotation angle has been adjusted. Thus, according to the embroidery frame 5 according to the present embodiment, the operations of locking and releasing the middle frame 52 in relation to the outer frame 54 are simple, and the convenience for the user can be improved.

Figure 11:
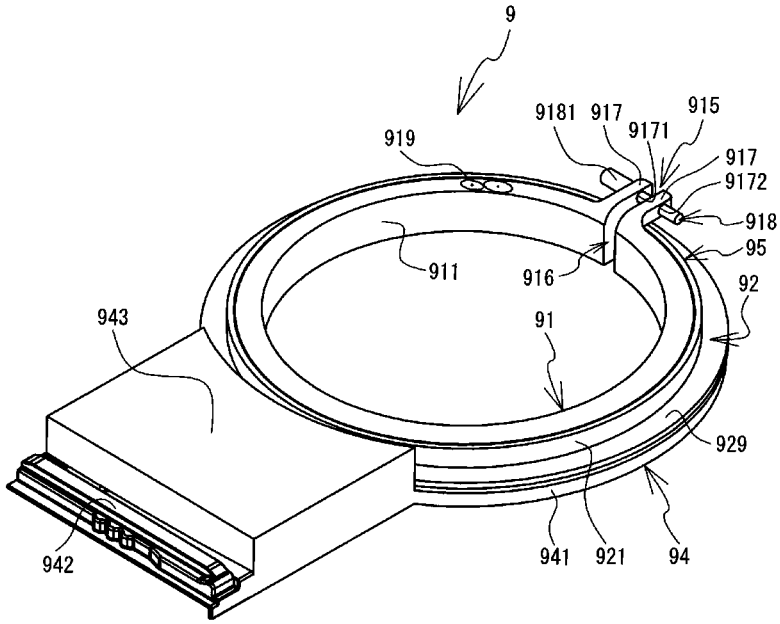
FIG. 11 is an oblique view of an embroidery frame 9 according to another embodiment.
Figure 12:
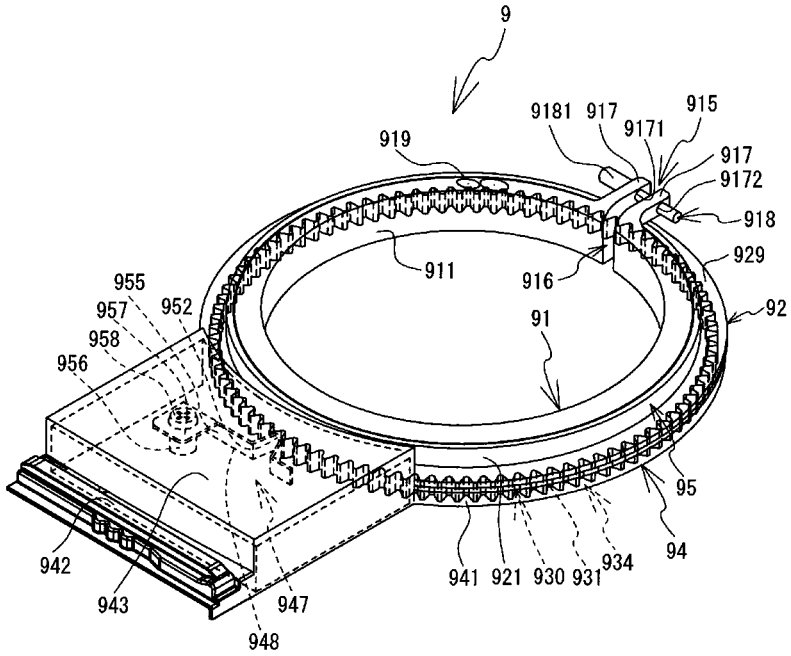
FIG. 12 is an oblique view that shows an internal structure of the embroidery frame 9.
Figure 13:
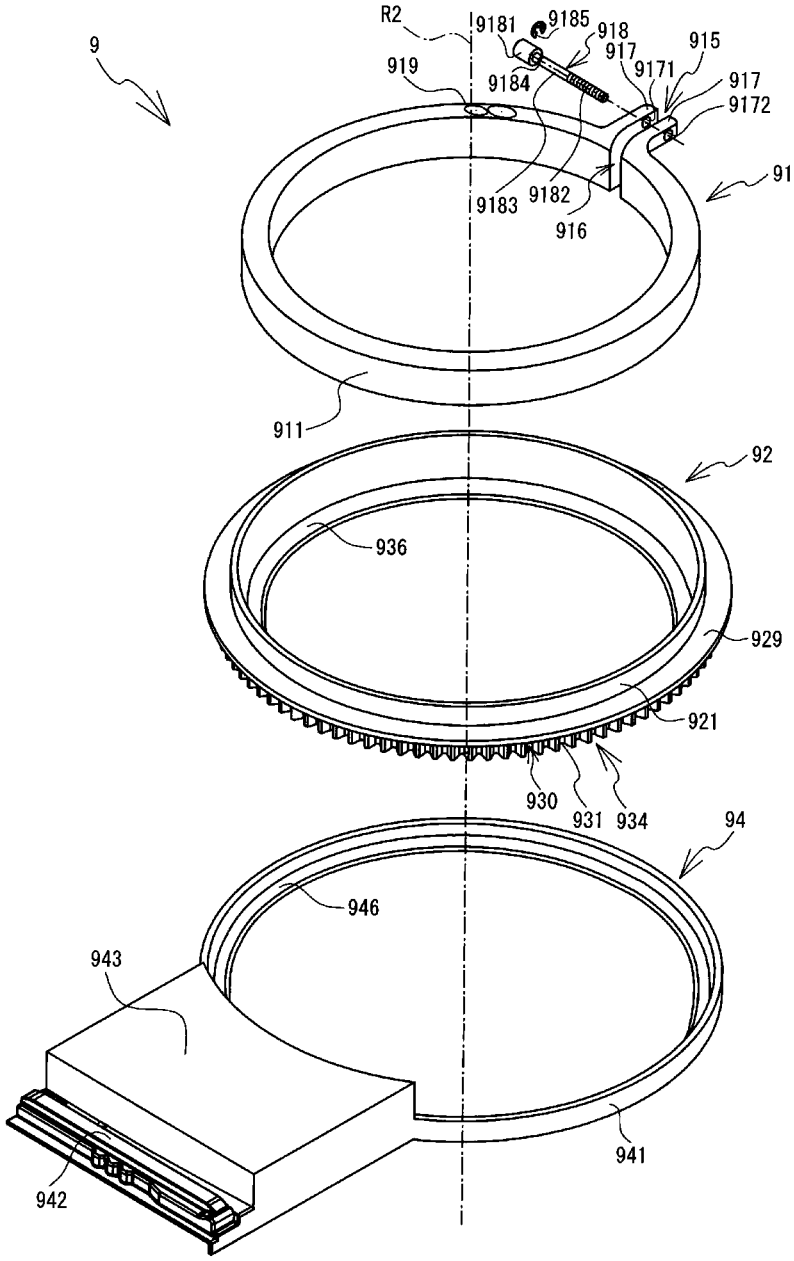
FIG. 13 is an exploded oblique view of the embroidery frame 9.

Note that the timing at which the user releases the grip portion 553 is not limited to the case where the one of the plurality of the first engaging portions 530 is in the position that corresponds to the projecting portion 552, as in the previously described example. The user may also take his fingers off the grip portion 553 when a portion of the outer circumferential face of the frame portion 521 where none of the first engaging portions 530 are located is positioned in the position that corresponds to the projecting portion 552. In that case, the energizing force of the coil spring 549 may cause the projecting portion 552 to come into contact with the outer circumferential face of the frame portion 521. In this state, when the user rotates the middle frame 52 (the assembled unit 55) in relation to the outer frame 54, the tip of the projecting portion 552 may slide along the outer circumferential face of the frame portion 521. When the middle frame 52 rotates to a position where one of the first engaging portions 530 is aligned with the projecting portion 552, the projecting portion 552 may be inserted into the one of the first engaging portions 530 by the elastic force of the coil spring 549, and the rotation of the middle frame 52 is locked. Therefore, just by rotating the middle frame 52, the user is able to lock the rotation of the middle frame 52 at the angle where the one of the first engaging portions 530 is provided Next, an embroidery frame 9 according to another embodiment will be explained with reference to FIGS. 11 to 15. As shown in FIGS. 11 to 13, the embroidery frame 9 includes an inner frame 91, a middle frame 92, and an outer frame 94, each of which has a circular frame shape. As shown in FIG. 11, the embroidery frame 9 is formed by disposing the middle frame 92 to the outside of the inner frame 91 in the radial direction and by disposing the outer frame 94 to the outside of the middle frame 92 in the radial direction. The inner frame 91 and the middle frame 92 can be rotated about a rotational axis R2 shown in FIG. 13, in relation to the outer frame 94. Note that, in the embroidery frame 9 according to the present embodiment, the rotational axis R2 passes thorough the center of each circle that is formed by each of the inner frame 91, the middle frame 92, and the outer frame 94 (specifically, frame portions 911, 921, and 941, which are described below). Hereinafter, the direction of the rotational axis R2 is simply referred to as an "axial direction". In the same manner as the embroidery frame 5 according to the first embodiment, the embroidery frame 9 has a structure in which the work cloth 100 can be clamped between the inner frame 91 and the middle frame 92, and the middle frame 92 can be rotated in relation to the outer frame 94.

As shown in FIGS. 11 to 13, the inner frame 91 includes a circular frame portion 911. The frame portion 911 has thicknesses in the axial direction and the radial direction. The inner flame 91 includes an adjustment portion 915 that allows the diameter of the inner frame 91 to be adjusted. The diameter of inner frame 91 may be adjusted according to the thickness of the work cloth 100 that is clamped between the inner frame 91 and the middle frame 92. The adjustment portion 915 includes a parting portion 916, a pair of screw mounting portions 917, and an adjusting screw 918. The parting portion 916 is a location where a portion in the circumferential direction of the frame portion 911 of the inner frame 91 is discontinuous through the axial direction. The pair of the screw mounting portions 917 are provided in upper portions of the frame portion 911 on both sides of the parting portion 916. The pair of the screw mounting portions 917 project to the outside in the radial direction and are positioned opposite one another. The pair of the screw mounting portions 917 are provided with holes 9171, 9172, which are through-holes in a direction that is orthogonal to the faces of the screw mounting portions 917 that are opposite one another (refer to FIG. 13). Of the two holes 9171, 9172, the hole 9172 (the hole on the lower right in FIG. 13) is provided with an embedded nut (not shown in the drawings) in which a threaded hole is formed.

As shown in FIG. 13, the adjusting screw 918 is a threaded member that includes a head portion 9181 and a shaft portion 9183. The head portion 9181 is a large-diameter portion that the user may grip with his fingers to rotate the adjusting screw 918. The shaft portion 9183 is a small-diameter portion that extends as a single piece from the head portion 9181. A male threaded portion 9182 is formed from approximately the center in the axial direction of the shaft portion 9183 to the tip. A narrow groove 9184, into which a retaining ring 9185 may be fitted, is also formed in the shaft portion 9183 in a location that is close to the head portion 9181. Note that, for ease of explanation, the retaining ring 9185 is omitted from all of the drawings except FIG. 13. The adjusting screw 918 may be mounted in the pair of the screw mounting portions 917 by passing the shaft portion 9183 through the hole 9171 and screwing the male threaded portion 9182 into the threaded hole in the not that is embedded in the hole 9172. In this state, the retaining ring 9185 can be fitted into the narrow groove 9184 of the shaft portion 9183. The adjusting screw 918 can be thus held such that it can rotate in the screw mounting portion 917 on the side where the hole 9171 is located and cannot move in the axial direction.

If the user grips the head portion 9181 with his fingers and performs a rotation operation, the screw mounting portion 917 on the side where the hole 9172 is located moves through the nut in the axial direction of the shaft portion 9183. The direction of movement of the screw mounting portion 917 may be determined by the direction of rotation of the adjusting screw 918. Thus the adjusting screw 918 may be coupled with the pair of the screw mounting portions 917 and is able to adjust the gap between the pair of the screw mounting portions 917 such as to make the gap wider or narrower. The adjusting of the gap between the pair of the screw mounting portions 917 adjusts the diameter of the inner frame 91 in accordance with the thickness of the work cloth 100. For example, to the extent that the gap between the pair of the screw mounting portions 917 becomes narrower, the diameter of the inner frame 91 becomes smaller, so the embroidery frame 9 is able to clamp the work cloth 100 that has a greater thickness between the middle frame 92 and the inner frame 91.

A marker 919 is provided on an edge face on the top side of the inner frame 91. In a case where a camera (not shown in the drawings) that is configured to capture an image of the marker 919 is provided in the head 14 of the sewing machine 1, for example, the sewing machine 1 is able to detect the rotation angle of the middle frame 92 in relation to the outer frame 94 based on the position of the marker 919 in the image that is captured by the camera.

As shown in FIGS. 11 to 13, the middle frame 92 includes a circular frame portion 921 that has an inside diameter that is larger than the outside diameter of the frame portion 911 of the inner frame 91. The middle frame 92 may be removably mounted on the inner frame 91 by removably mounting the frame portion 921 of the middle frame 92 on the outer side of the frame portion 911 of the inner frame 91 in the radial direction. As shown in FIGS. 12 to 15, a plurality of first engaging portions 930 are provided on the outer circumferential side face of the lower edge portion of the frame portion 921. In the present embodiment, each of the first engaging portions 930 is formed as a recessed portion 931 that is formed approximately in the shape of a V. The recessed portions 931 are recessed in the direction away from the outer frame 94, that is, in the direction toward the inner side of the middle frame 92 in the radial direction. The recessed portions 931 are formed at intervals of a specified angle around the entire outer circumferential side face of the lower edge portion of the frame portion 921 of the middle frame 92. In the present embodiment, ninety recessed portions 931 are provided at intervals of four degrees, as an example. In the present embodiment, the recessed portions 931, in their entirety, are formed in the shape of a gear. Hereinafter, the portion of the middle frame 92 where the recessed portions 931 form the gear is called a ear portion 934. In the present embodiment the middle frame 92 can be locked in relation to the outer frame 94 at one of a plurality of predetermined rotation angles (one rotation angle every four degrees) by engaging a second engaging portion 947, which will be described later, with one of the plurality of the recessed portions 931.

A flange portion 929 is provided in a central portion in the axial direction of the outer circumferential side face of the frame portion 921, on the upper side of the gear portion 934. The flange portion 929 projects to the outside in the radial direction around the entire circumference of the frame portion 921. A support portion 936 is provided on an inner circumferential side face of the lower edge of the frame portion 921. The support portion 936 projects to the inside in the radial direction around the entire circumference of the frame portion 921. The support portion 936 is a portion that supports a lower edge face of the inner frame 91.

As shown in FIGS. 11 to 13, the outer frame 94 includes a circular frame portion 941. A support portion 946 is provided on an inner circumferential side face of the lower edge of the frame portion 941. The support portion 946 projects to the inside in the radial direction around the entire circumference of the frame portion 941. The support portion 946 is a portion that supports a lower edge face of the middle frame 92 (refer to FIG. 15). An attachment portion 942 is provided on the outer side of the frame portion 941 in the radial direction. The shape and function of the attachment portion 942 are the same as those of the attachment portion 542 in the first embodiment (refer to FIG. 4).

Figure 14:
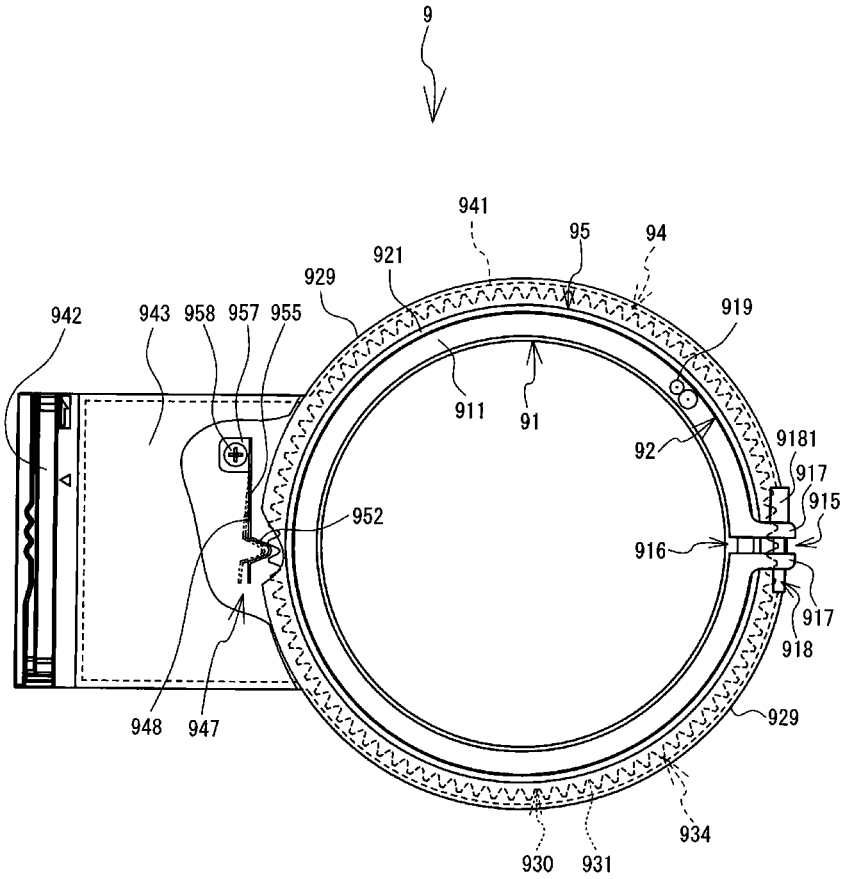
FIG. 14 is a plan view of the embroidery frame 9.

A box-shaped coupling portion 943 that couples the frame portion 941 and the attachment portion 942 is provided between the frame portion 941 and the attachment portion 942. As shown in FIGS. 12 and 14, the second engaging portion 947 is provided in the interior of the coupling portion 943, near the edge on the side of the frame portion 941 (the side that faces toward the middle frame 92). In the present embodiment, the second engaging portion 947 is formed as a flat spring 948 that includes a base end portion 957 and a free end portion 955.

Figure 15:
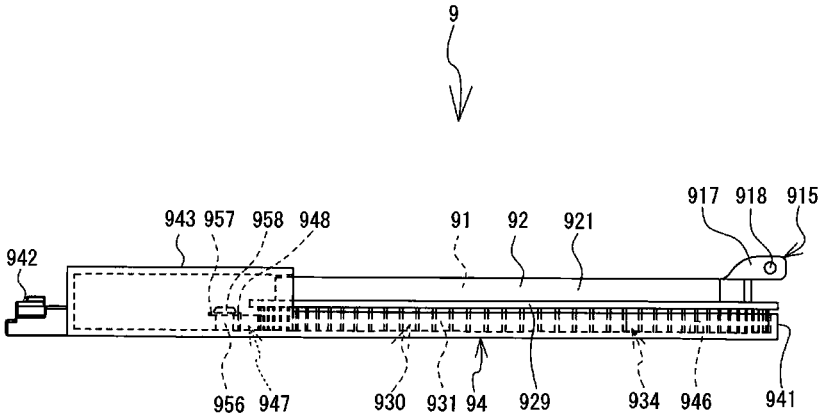
FIG. 15 is a side view of the embroidery frame 9.

As shown in FIG. 15, a threaded attachment portion 956 is provided inside the coupling portion 943 on one side (the upper side in FIG. 14) in the width direction of the coupling portion 943 (the direction parallel to the attachment portion 942). The threaded attachment portion 956 is a cylindrical member that projects upward from a bottom face of the coupling portion 943. A threaded hole (not shown in the drawings) is formed in the up-down direction in the threaded attachment portion 956. As shown in FIGS. 14 and 15, the base end portion 957 of the flat spring 948 is disposed on the top side of the threaded attachment portion 956 such that the flat face of the base end portion 957 is horizontal. A hole (not shown in the drawings) is provided in the center of the base end portion 957. The base end portion 957 of the flat spring 948 is fixed to the threaded attachment portion 956 by screwing a screw 958, which passes through the hole, into the threaded hole of the threaded attachment portion 956 from above.

As shown in FIG. 14, the free end portion 955, which extends from the base end portion 957 of the flat spring 948, is bent downward (toward the rear of FIG. 14) at the right edge (the right side in FIG. 14) of the base end portion 957 and extends toward the front (toward the bottom of FIG. 14). A protruding portion 952 that is formed approximately in the shape of a V, such that it protrudes toward the middle frame 92, is provided at the front end of the free end portion 955. The tip of the protruding portion 952 is able to engage with one of the recessed portions 931. The elastic force of the flat spring 948 energizes the protruding portion 952 in such a direction that the tip of the protruding portion 952 is inserted into the recessed portion 931 and presses against the recessed portion 931.

The engaging of the tip of the protruding portion 952 with one of the recessed portions 931 and its pressing against the recessed portion 931 by the elastic force of the flat spring 948 can lock the middle frame 92 such that it cannot be rotated in relation to the outer frame 94. When the user rotates the middle frame 92 in relation to the outer frame 94, one of the oblique faces of the recessed portion 931 (one of the oblique faces of the V shape) pushes the protruding portion 952 in the direction away from the middle frame 92, in opposition to the elastic force of the flat spring 948. At this time, the free end portion 955 of the flat spring 948 bends such that the engagement of the protruding portion 952 and the recessed portion 931 is released. Then the protruding portion 952 engages with the recessed portion 931 that is adjacent to the recessed portion 931 with which the protruding portion 952 was engaged previously.

If the rotating of the middle frame 92 is continued further, the engaging and the releasing of the engagement of the protruding portion 952 with one of the recessed portions 931 are repeated. In the present embodiment, the plurality of the recessed portions 931 are provided at four-degree intervals, an the user is able to set the rotation angle of the middle frame 92 in relation to the outer frame 94 at four-degree intervals.

The method for combining the inner frame 91, the middle frame 92, and the outer frame 94 will be explained. First, the user may place the middle frame 92 on a desktop or the like such that the gear portion 934 is on the bottom side. Then the user may insert the inner frame 91 into the inner side of the middle frame 92, in the same manner as in the previously described first embodiment, and the work cloth 100 may be clamped between the inner frame 91 and the middle frame 92. By adjusting the adjustment portion 915, the user may adjust the diameter of the inner frame 91 in accordance with the thickness of the work cloth 100. In the explanation that follows, the frame that is formed by the combining of the inner frame 91 and the middle frame 92 is called an assembled unit 95 (refer to FIG. 11). Note that in the present embodiment, the work cloth 100 is omitted from the drawings.

Next, the user may place the assembled unit 95 into the outer frame 94 from the top side of the outer frame 94. At this time, the user may place the assembled unit 95 into the frame portion 941 such that the protruding portion 952 engages with one of the plurality of the recessed portions 931. When the assembled unit 95 is placed into the frame portion 941, a state is created in which the protruding portion 952 is engaged with one of the recessed portions 931. Thus the second engaging portion 947 and the first engaging portion 930 may be engaged, and the middle frame 92 (the assembled unit 95) may be locked in relation to the outer frame 94. The inner frame 91, the middle frame 92, and the outer frame 94 can be combined as described above to obtain the completed form of the embroidery frame 9. The user is able to attach the completed form of the embroidery frame 9 to the sewing machine 1 (refer to FIG. 1) and to rotate and lock the middle frame 92 (the assembled unit 95) in relation to the outer frame 94.

An example of a method for performing the setting of the rotation angle of the middle frame 92 in relation to the outer frame 94 will be explained. For example, an image that includes the marker 919 that is provided on the edge face on the top side of the inner frame 91 may be captured by the camera (not shown in the drawings) that is provided in the head 14 of the sewing machine 1. A control circuit of the sewing machine 1 may specify the current rotation angle of the middle frame 92 based on the position of the marker 919 in the image and display the rotation angle on the liquid crystal display 15. In this case, the user is able to adjust the rotation angle of the middle frame 92 at four-degree intervals while referring to the rotation angle of the middle frame 92 that is displayed on the liquid crystal display 15.

As described above, according to the embroidery frame 9 according to the present embodiment, the user is able to lock the middle frame 92 in relation to the outer frame 94 at any one of a plurality of predetermined rotation angles at four-degree intervals. Therefore, the angle can be adjusted more easily than the angle can be adjusted by checking a graduated scale or markings. Furthermore, the user is able to adjust the rotation angle of the middle frame 92 to the desired angle by selecting the desired recessed portion 931 from among the plurality of the recessed portions 931.

Furthermore, the tip of the protruding portion 952 can be inserted into the recessed portion 931 and can be pressed against the recessed portion 931 by the energizing of the protruding portion 952 toward the middle frame 92 by the elastic force of the flat spring 948. Thus the middle frame 92 can be reliably locked in relation to the outer frame 94 at one of the predetermined angles. The engaging and the releasing of the engagement of the protruding portion 952 with the recessed portions 931 may be repeated, and the middle frame 92 can be rotated in relation to the outer frame 94, simply by the user's performing of the rotation operation on the middle frame 92. The user is thus able to easily rotate the middle frame 92 to the desired angle. Moreover, the operation of adjusting the rotation angle may be easier than it is with the known embroidery frame, in which the middle frame may be locked in relation to the outer frame by a screw so the convenience for the user can be improved.

Note that the present disclosure is not limited to the embodiments that are described above, and various types of modifications can be made. The shapes and sizes of the first engaging portions 530, 930 and the second engaging portions 547, 947 are not limited to the examples that are shown in the embodiments that are described above, as long as the second engaging portions 547, 947 and the corresponding first engaging portions 530, 930 can engage with each other. The frames on which the first engaging portions 530, 930 and the second engaging portions 547, 947 are respectively provided may also be the reverse of what they are in the embodiments that are described above. That is, the first engaging portions 530, 930 may respectively be provided on the outer frames 54, 94, and the second engaging portions 547, 947 may respectively be provided on the middle frames 52, 92. For example, the first engaging portions 530 may be provided on the frame portion 541 of the outer frame 54 such that they are recessed in the direction away from the middle frame 52, that is, toward the outside in the radial direction of the outer frame 54, and the second engaging portion 547 may be provided on the middle frame 52 such that it includes a projecting portion 552 that is energized toward the outer frame 54. To take another example, a gear portion that includes the first engaging portions 930 may be provided on the inner circumferential side face of the outer frame 94 such that the first engaging portions 930 are recessed in the direction away from the middle frame 92, that is, toward the outside in the radial direction of the outer frame 94, and the second engaging portion 947 (the flat spring 948) may be provided on the middle frame 92 and be energized toward the outer frame 94.

The first engaging portions 530, 930 can be provided in positions that correspond to any rotation angles other than the angles that are used as examples in the embodiments that are described above.

The structure for switching the positional relationship of the middle frame 52 and the outer frame 54 between the positional relationship in which the second engaging portion 547 can engage with one of the first edge engaging portions 531 and the positional relationship in which the second engaging portion 547 can engage with one of the second edge engaging portions 532 is not limited to the example in the first embodiment that is described above. For example, the first engaging portions 530 (the first edge engaging portions 531 and the second edge engaging portions 532) that engage with the second engaging portion 547 may also be changed by switching the state of the second engaging portion 547 instead of by switching the state of the middle frame 52. Specifically, the second engaging portion 547 may also be configured such that it can be inverted vertically, such that it can be switched between a state in which the projecting portion 552 is positioned on the top side and a state in which the projecting portion 552 is positioned on the bottom side. In that case, the second engaging portion 547 may be configured such that when the projecting portion 552 is positioned on the top side, it can engage with one of the first edge engaging portions 531 on the top side, and when the projecting portion 552 is on the bottom side, it can engage with one of the second edge engaging portions 532 on the bottom side.

The apparatus and methods described above with reference to the various embodiments are merely examples. It goes without saying that they are not confined to the depicted embodiments. While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. An embroidery frame comprising:

an inner frame, the inner frame having a circular form;

a middle frame configured to be detachably attachable to the inner frame, the middle frame having a circular form, an inside diameter of the middle frame being longer than an outside diameter of the inner frame, the inner frame being configured to be mountable in the middle frame;

an outer frame configured to rotatably hold the middle frame, the outer frame having a circular form, an inside diameter of the outer frame being longer than an outer outside diameter of the middle frame, the middle frame being configured to be mountable in the outer frame; and an engaging portion comprising:

a plurality of first engaging portions provided along a circumferential direction of a first frame, the first frame being one of the middle frame and the outer frame, the plurality of first engaging portions being provided at a plurality of positions on the first frame in accordance with a predetermined plurality of rotation angles; and a second engaging portion configured to engage with any one of the plurality of first engaging portions, the second engaging portion being provided on a second frame, the second frame being the other of the middle frame and the outer frame that is different from the first frame.

2. The embroidery frame according to claim 1, wherein each of the plurality of the first engaging portions is a recessed portion, each of the recessed portion being recessed toward a first direction away from the second frame, and the second engaging portion further comprises:

a projecting member configured to engage with any one of the plurality of the recessed portions, the projecting member projecting toward the recessed portion, and a pressing member configured to press the projecting member toward the first frame.

3. The embroidery frame according to claim 1, wherein the plurality of the first engaging portions comprises:

a plurality of third engaging portions which are provided on one edge of the first frame along a rotational axis direction of the first frame, the plurality of third engaging portions being provided in positions in accordance with a plurality of predetermined first rotation angles; and a plurality of forth engaging portions which are provided on the other edge of the first frame along the rotational axis direction, the plurality of the forth engaging portions being provided in positions in accordance with a predetermined plurality of second rotation angles, one or more of the second rotation angles being different from the first rotation angels, wherein the middle frame and the outer frame are configured to be changeable to either a first state or a second state, the first state representing a state in which any one of the plurality of the third engaging portions engages with the second engaging portion, the second state representing a state in which any one of the plurality of the forth portions engages with the second engaging portion.

4. The embroidery frame according to claim 3, wherein the first frame is the middle frame, wherein the second frame is the outer frame, and wherein the middle frame is configured to be mountable to the outer frame in either the first state or in the second state.

5. The embroidery frame according to claim 4, wherein the middle frame further comprises:

a connecting portion which includes one end of the middle frame along the circumferential direction of the middle frame and the other end of the middle frame along the circumferential direction of the middle frame, the one end of the middle frame and the other end of the middle frame protruding radially outward outward, the one end of the middle frame and the other end of the middle frame being opposed to each other; and a flange which protrudes radially outward, the flange being provided around the middle frame;

wherein the connecting portion further comprises:

a first hole which is provided on an opposing surface of the one end of the middle frame; and a second hole which is provided on an opposing surface of the other end of the middle frame, a screw configured to be inserted into the first hole and the second hole, and wherein the outer frame further comprises:

a first supporting portion configured to support the connecting portion; and a second supporting portion configured to support the flange.

* * * * *